United States Patent [19]

Candelora et al.

[11] Patent Number: 5,021,819

[45] Date of Patent: Jun. 4, 1991

[54] CIRCUIT BREAKER WITH POSITIVE OVER-CENTER ACCELERATION

[75] Inventors: Andrew M. Candelora, East Haven; Kevin F. Nolan, Woodbury; Gary D. Magnon, Bristol; Raymond K. Seymour, Plainville, all of Conn.

[73] Assignee: General Electric Company, New York, N.Y.

[21] Appl. No.: 563,588

[22] Filed: Aug. 6, 1990

[51] Int. Cl.[5] ..... H01H 75/00

[52] U.S. Cl. ..... 335/15; 335/167; 335/172

[58] Field of Search ..... 335/6, 14, 15, 21, 22, 335/35, 167–174

[56] References Cited

U.S. PATENT DOCUMENTS

| | | | |
|---|---|---|---|
| 3,002,068 | 9/1961 | Maier | 200/88 |
| 4,259,651 | 3/1981 | Yamat | 335/170 |
| 4,278,958 | 7/1981 | Kandatsu | 335/16 |
| 4,302,740 | 11/1981 | Maier et al. | 335/21 |
| 4,375,021 | 2/1983 | Pardini et al. | 200/147 |
| 4,507,527 | 3/1985 | Pardini | 200/145 |
| 4,622,530 | 11/1986 | Ciarcia et al. | 335/21 |
| 4,736,174 | 4/1988 | Castonguay et al. | 335/167 |
| 4,825,183 | 4/1989 | Hauschildt | 335/167 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A molded case circuit breaker includes an operating handle yoke that contacts the cradle operator and drives the operating mechanism springs over-center when the circuit breaker operating handle is moved from its RESET to its ON position. The contact between the handle yoke and cradle operator accelerates the over-centering of the powerful operating mechanism springs.

10 Claims, 5 Drawing Sheets

CIRCUIT BREAKER WITH POSITIVE OVER-CENTER ACCELERATION

BACKGROUND OF THE INVENTION

Current limiting circuit interruption devices such as that described within U.S. Pat. No. 4,375,021 require a large separation distance between the circuit breaker contacts that become electrodynamically repulsed upon short circuit overcurrent conditions. The increased contact separation distance further requires a longer handle stroke to move the circuit breaker operating handle between its "ON" and "OFF" positions. However, the placement of an electronic trip unit and selected circuit breaker accessories in the circuit breaker cover as described within U.S. Pat. No. 4,507,527 limits the circuit breaker operating handle path. It would be advantageous therefore to over-center the circuit breaker operating mechanism springs in the shortest operating handle path to optimize the transfer of the circuit breaker contacts between their "OFF" and "ON" positions, in the shortest distance of travel of the circuit breaker operating handle.

U.S. Pat. No. 3,002,068 describes a bail that is pivotally attached to the circuit breaker operating handle yoke to assist the operating springs in moving to their over-center position. The pivotal arrangement of the bail requires a pair of guides on the operating mechanism side frames to position the bail with respect to the cradle linkage. It is believed that the bail and guides can be eliminated by simplified means integrally-formed with the operating handle yoke to effect an efficient and inexpensive over-center accelerator for the operating mechanism springs.

One purpose of the instant invention is to provide a simple and economic over-center accelerator function to the circuit breaker operating handle to rapidly drive the operating mechanism springs to their over-center positions in the early stages of the circuit breaker operating handle stroke.

SUMMARY OF THE INVENTION

The operating handle yoke of a molded case circuit breaker that connects with the circuit breaker operating springs at one end and the operating mechanism side frame at an opposite end is fitted with a pair of opposing projections intermediate its ends to interact with the operating springs and drive the operating springs to their over-center condition when the operating handle is moved to the circuit breaker "ON" position. The projections are formed on the edges of the handle yoke distal the movable contact arms to release the operating springs from interaction with the projections when the operating handle is moved to the circuit breaker "OFF" position.

DESCRIPTION OF THE PREFERRED EMBODIMENT

Figure 1:
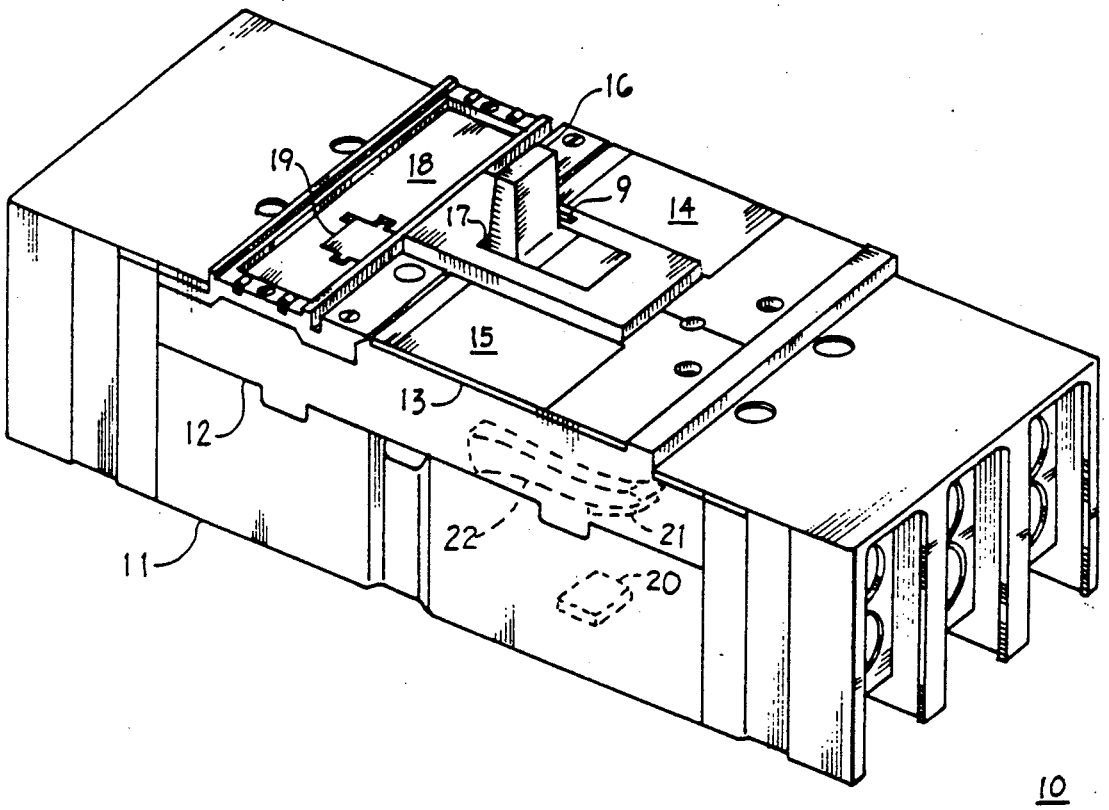
FIG. 1 is a top perspective view of a molded case circuit breaker including the operating mechanism springs over-center accelerator feature in accordance with the invention.

An electronic trip circuit breaker, hereafter "circuit breaker" 10 is depicted in FIG. 1 and consists of a molded plastic case 11 to which a molded plastic cover 12 is fixedly secured. Although not shown, an operating mechanism is arranged to automatically drive a movable contact arm 22 and attached movable contact 21 away from the fixed contact 20 upon the occurrence of predetermined overcurrent conditions for a predetermined period of time to interrupt circuit current. An electronic trip unit 18 is positioned within the circuit breaker cover and a rating plug 19 electrically connects with the trip unit to set the circuit breaker ampere rating. An operating handle 16 extends through an access slot 17 for manual intervention to turn the circuit breaker contacts between their open and closed conditions. A visual access slot 9 formed through the circuit breaker cover allows for operator verification of the condition of the circuit breaker contacts. Accessory doors 14, 15 formed within the accessory cover 13 allow access to selected circuit breaker accessories contained therein. The circuit breaker operating handle 16 is in its upright "TRIPPED" position which occurs when the operating mechanism has become articulated to drive the movable contact arm 22 and movable contact 21 to the position indicated in FIG. 1.

Figure 2:
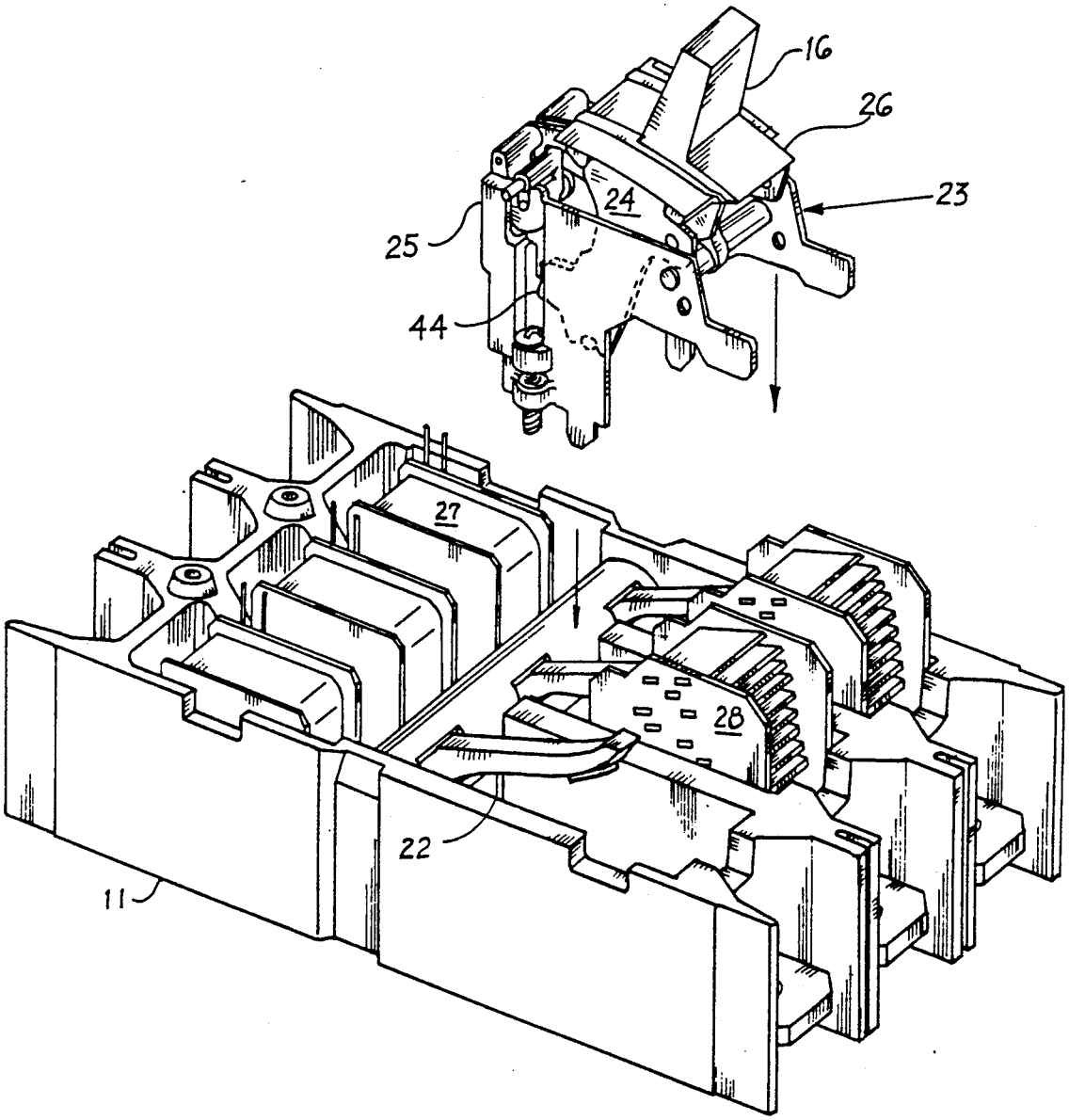
FIG. 2 is a top perspective view of the circuit breaker of FIG. 1 with the operating mechanism and operating handle assembly in isometric projection.

The circuit breaker case 11 is shown in FIG. 2 prior to installing an operating mechanism 23 to which the latch assembly 25, handle yoke 24 and positive over-center accelerator projection 44, hereafter "projection" have been pre-assembled. The latch assembly and operating mechanism are described within U.S. Patent application Ser. No. 526,481 filed May 21, 1990, entitled "Molded Case Circuit Breaker Compact Latch Assembly", which Application is incorporated herein for purposes of reference. The operating handle 16 is attached to the handle yoke by means of the handle skirt portion 26. The current transformers 27, movable contact arms 22 and arc chutes 28 are assembled within the circuit breaker case before the operating mechanism, latch assembly and handle yoke are assembled as a single unit.

Figure 3:
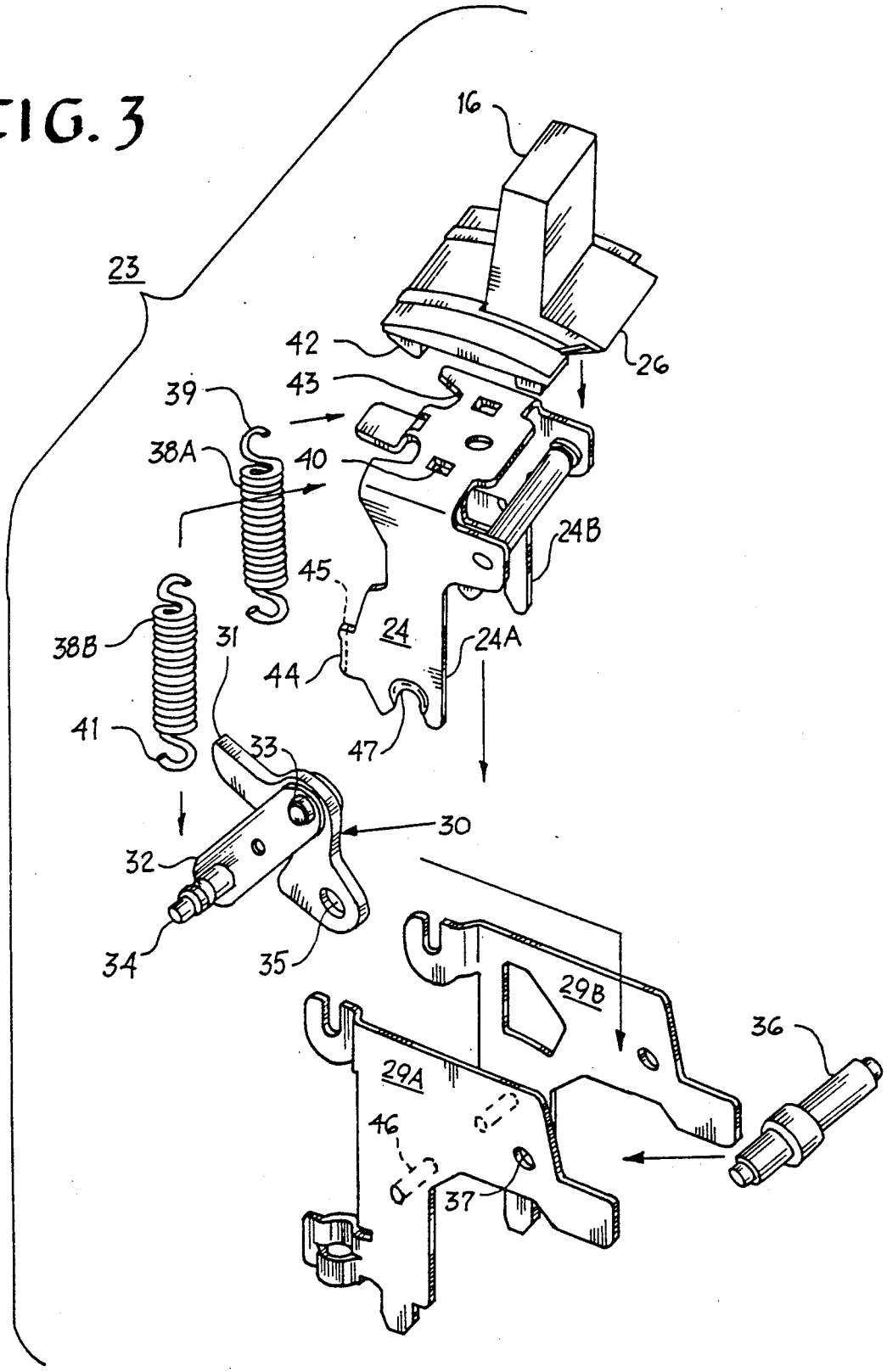
FIG. 3 is a top perspective view of the operating mechanism and operating handle assembly components prior to assembly.

The pre-assembly of the operating handle 16 and handle yoke 24 onto the operating mechanism side frames 29A, 29B of the operating mechanism 23 is best seen by referring now to FIG. 3. The operating mechanism 23 is similar to that described within the aforementioned U.S. Pat. No. 4,736,174 and includes a cradle operator 30 having a hook-shaped end 31 and supported between a pair of opposing links 32 by means of a pivot pin 33. The links are connected at the opposite end by means of a roller pin 34. The powerful operating mechanism springs 38A, 38B are attached to the handle yoke 24 by the insertion of the top hooks 39 at one end of the operating springs within apertures 40 formed within the top of the handle yoke. The bottom hooks 41 of the operating springs are positioned over the roller pin 34 which is free to rotate along with the cradle operator 30 when the handle yoke is positioned within the opposing mechanism side frames 29A, 29B and the cradle operator 30 is arranged between the side frames by positioning the support pin 36 within the aperture 35 formed through the opposite end of the cradle operator and through the apertures 37 formed within the mechanism side frames. The operating handle 16 is attached to the handle yoke 24 by positioning the posts 42 depending from the bottom of the handle skirt 26 within the corresponding apertures 43 formed through the top of the handle yoke, and the handle yoke is supported upon pivot pins 46 projecting inwardly from the mechanism side frames by positioning the slots 47 on the bottom of the yoke over the pivot pins. For purposes of this disclosure, the operating springs become over-centered when they pass over the top center line measured between the operating handle 16 and the handle yoke pivot pins 46. In accordance with the invention, the projection 44 formed on the opposing sides 24A, 24B of the handle yoke 24 include a step 45 projecting inwardly from the sides of the handle yoke to interact with the roller pin 34 in the manner best seen by referring now to FIGS. 4A and 4B.

As described in the aforementioned U.S. Pat. No. 4,736,174, the circuit breaker contacts 20, 21 depicted earlier in FIG. 1 are brought to their closed position by moving the circuit breaker handle to the closed position which drives the handle yoke and the attached operating springs over-center with respect to the handle yoke pivot pins. To reduce the distance that the operating handle must travel in order for the operating springs to go over-center with respect to the handle yoke pivots, the projections 44 on the handle yoke 24 trap the roller pin 34 by the interference between the steps 45 projecting inwardly from the projections into contact with the roller pin 34 to drag the roller pin and the attached operating mechanism springs in unison with the travel of the operating handle 16. In prior art circuit breaker operating mechanisms, the operating handle 16 connects with the mechanism springs solely by trapping the operating springs between the handle yoke 24 and the roller pin 34. The operating springs could increase in flex over long periods of continued use. The resulting decrease in tension between the operating springs and the roller pin could correspondingly increase the time in which the operating springs over-center in response to the movement of the operating handle. In accordance with the instant invention, the accelerator projections 44 immediately contact the roller pin upon movement of the operating handle in the ON direction and rotate the roller pin and the operating springs to their over-center position when the operating handle 16 is rotated in the counterclockwise direction as viewed in FIG. 3.

Figure 4A:
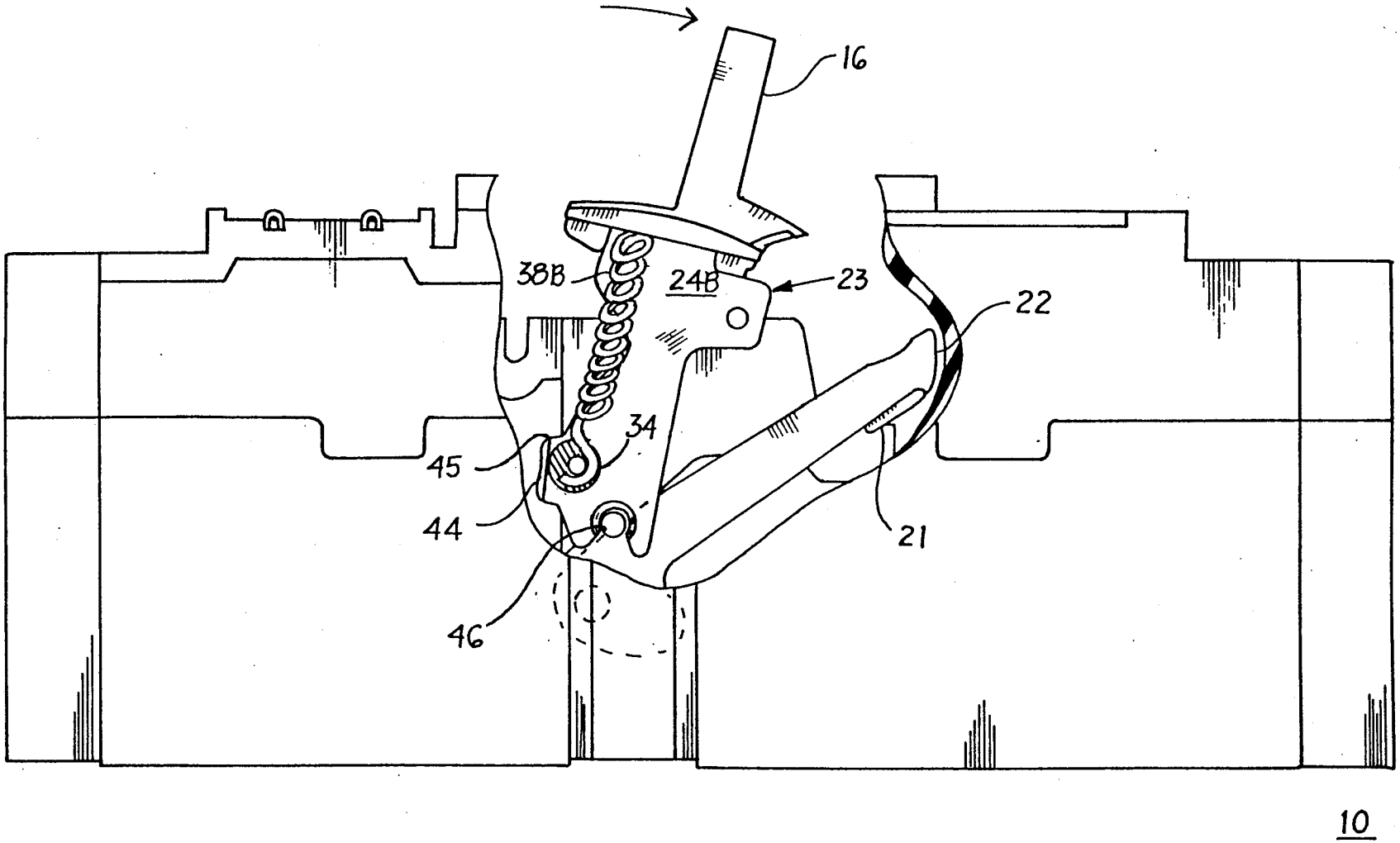
FIGS. 4A and 4B are cutaway side views of the circuit breaker of FIG. 1 depicting the operating mechanism and the operating mechanism springs immediately prior to and immediately after over-centering.
Figure 4B:
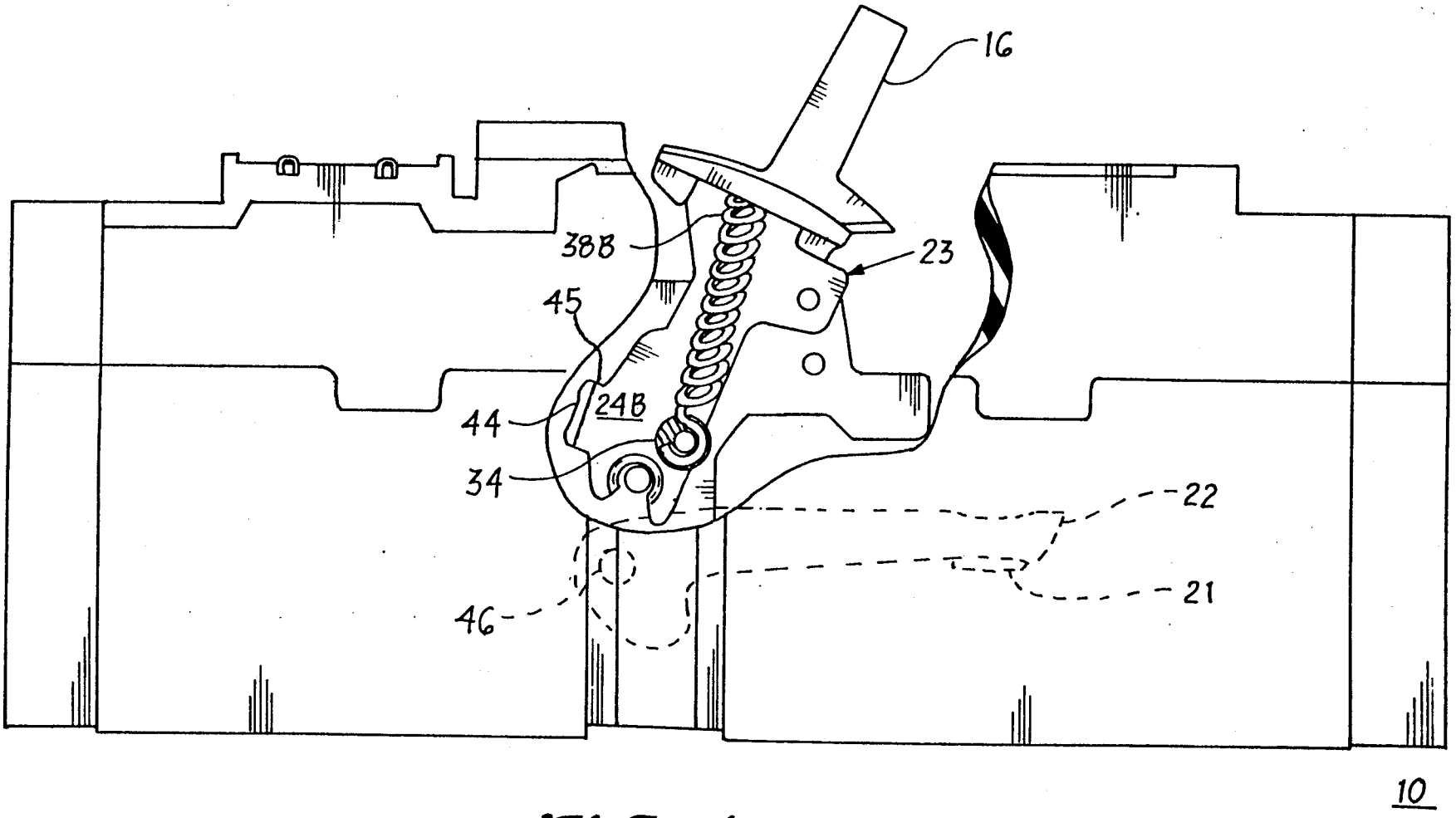

Referring now to FIGS. 4A, 4B, wherein the front side frame of the operating mechanism 23, the front yoke and the first operating spring are removed to show the capture of the roller pin 34 by the step 45 on the projection 44 formed on the side 24B of the handle yoke as the operating handle 16 is first moved in the clockwise direction as indicated. The operating spring 38B is to the left of the handle yoke pivot 46 and is in the process of being rotated to its over-center position with respect to the handle yoke pivot. Continued rotation of the operating handle 16 directly drives the roller pin 34 and operating spring 38B over-center with respect to the handle yoke pivot causing the immediate collapse of the operating mechanism 23 driving the movable contact arm 22 and attached movable contact 21 to the closed position shown in FIG. 4B.

In returning the operating mechanism to its open condition, the operating handle 16 is moved counterclockwise as viewed in FIGS. 4A, 4B which automatically moves the step 45 on the projection 44 away from the roller pin 34 as the attached handle yoke and operating springs move to their over-center position in the opposite direction from that viewed in FIGS. 4A, 4B.

An inexpensive means for accelerating the over-centering of circuit breaker operating springs has herein been disclosed. The orientation of the acceleration projections formed on the operating handle yoke allows the projections to interact with the operating mechanism springs during the closing of the circuit breaker contacts and automatically removes the projections from such interaction when the operating springs are moved over-center in the opposite direction.

Having thus described our invention, what we claim as new and desire to secure by Letters Patent is:

1. A circuit breaker having positive over-center acceleration comprising:

a circuit breaker case and cover;

a pair of contacts within said case arranged for automatic separation upon occurrence of an overcurrent condition within a protected circuit;

an operating mechanism within said case providing said automatic separation, said operating mechanism including a pair of opposing side frames supporting a handle yoke and an operating handle, said operating handle having ON and OFF positions on said circuit breaker case, said operating handle being arranged for manually moving said contacts between corresponding ON and OFF conditions;

a pair of operating springs within said operating mechanism attached to said handle yoke at one end and to a roller at an opposite end whereby moving said operating handle to said ON position over-centers said operating springs to snappingly drive said contacts to said ON condition; and accelerator means formed on said handle yoke actively engaging said roller and causing said roller to move in unison with said handle yoke to drive said operating springs over-center.

2. The circuit breaker of claim 1 wherein said handle yoke includes a pair of side pieces joined by a top bight.

3. The circuit breaker of claim 1 wherein said accelerator means comprises a projection integrally-formed on one edge of said yoke side pieces.

4. The circuit breaker of claim 3 including a step formed on said projection inboard said side pieces, said step capturing an end of said roller to cause said roller to move in unison with said handle yoke as said operating handle is moved to said ON position.

5. The circuit breaker of claim 4 wherein said step releases said end of said roller when said operating handle is moved to said OFF position.

6. The circuit breaker of claim 1 including a pair of links pivotally-attached to said roller at one end and to a cradle at an opposite end thereof.

7. The circuit breaker of claim 6 wherein said cradle includes an aperture at one end and a hook at an opposite end.

8. The circuit breaker of claim 6 wherein said cradle is pivotally-attached to said side frames at said apertured end.

9. The circuit breaker of claim 8 wherein said cradle is pivotally-attached to said pair of links intermediate its apertured end and its hook-shaped end.

10. The circuit breaker of claim 3 wherein said one edge of said handle yoke is distal said contacts.

* * * * *